US008052310B2

(12) United States Patent
Gingrinch, III et al.

(10) Patent No.: US 8,052,310 B2
(45) Date of Patent: Nov. 8, 2011

(54) LIGHTING DEVICE

(75) Inventors: Charles Raymond Gingrinch, III, Mechanicsburg, PA (US); Christopher George Daily, Harrisburg, PA (US); Matthew E. Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 275 days.

(21) Appl. No.: 12/465,962

(22) Filed: May 14, 2009

(65) Prior Publication Data

US 2010/0290236 A1 Nov. 18, 2010

(51) Int. Cl.
*F21V 3/00* (2006.01)
*F21V 5/00* (2006.01)

(52) U.S. Cl. ..... 362/311.02; 362/800

(58) Field of Classification Search ..... 362/249.02, 362/311.02, 647, 649, 651, 800
See application file for complete search history.

(56) References Cited

FOREIGN PATENT DOCUMENTS

| | | |
|---|---|---|
| DE | 20 2008 015 948 | 2/2009 |
| WO | WO 2007/034361 | 3/2007 |

OTHER PUBLICATIONS

International Search Report, International Application No. PCT/US2010/001388, International Filing Date Nov. 5, 2010.

*Primary Examiner* — Jason Moon Han

(57) ABSTRACT

A lighting device includes an outer assembly, a light emitting device, and a contact. The outer assembly extends between a base end and a light emitting end. The outer assembly includes a contact carrier sub-assembly that extends from the base end to an outer end disposed proximate to the light emitting end. The light emitting device is disposed proximate to the light emitting end of the outer assembly. The contact is held in the contact carrier sub-assembly and extends from the base end of the outer assembly to the outer end of the contact carrier subassembly. The contact is electrically coupled with the light emitting device to provide a continuous electrically conductive path from the base end of the outer assembly to the outer end of the contact carrier sub-assembly. The contact is configured to supply electric current to the light emitting device.

10 Claims, 8 Drawing Sheets

LIGHTING DEVICE

BACKGROUND OF THE INVENTION

The subject matter herein relates generally to lighting devices and, more particularly, to assemblies that house and supply electric current to lighting devices.

Known lighting assemblies including lighting devices that emit light out of the assemblies in desired directions. Some lighting assemblies include light emitting diodes (LEDs) that emit light from a light emitting surface of the assemblies. The assemblies typically include several interconnected components or parts that are used to house the LED and other components used to operate the LED. For example, the LED may be mounted on a circuit board in a housing of the lighting assembly. The housing may be formed of one or more parts, such as heat sinks, optical lenses, additional circuit boards, and the like. Moreover, one or more additional electronic components used to operate the LED may be mounted on the circuit board or on an additional circuit board located in the housing. For example, an LED driver may be mounted to the same circuit board as the LED or to an additional circuit board. The electronic components receive electric current from an external source and use the current to drive, or activate, the LED and cause the LED to emit light from the lighting assembly. The various components in some known lighting assemblies may be secured together using adhesives, latching devices, and the like.

The LED and electronic components located within the housing may be electronically joined with one another by one or more internal contacts located in the housing. Additionally, the LED and electronic components may be coupled with the external source by one or more external contacts that extend from inside to outside of the housing. The external contacts may be coupled with the external source of electric current to supply the current to the LED and electronic components. In some known lighting assemblies, these contacts, circuit boards, components and LEDs are soldered together during assembly of the lighting assemblies.

In general, as the number of interconnected components and electrical components in the lighting assemblies increases, the complexity and cost of manufacturing the lighting assemblies also increases. For example, some known lighting assemblies include interconnected housing components such as heat sinks, contact housings, optical lenses, and the like, that are secured together by adhesives, such as thermal adhesives. The application of the adhesives increases the cost and time involved in manufacturing the lighting assemblies. Additionally, the manufacturing process of some known lighting assemblies uses several soldering steps to electrically couple the several electronic components. As the number of soldering steps and solder connections between components increases, the cost and complexity involved in manufacturing the lighting assemblies also may increase.

A need exists for lighting assemblies that include fewer components and/or manufacturing steps. Eliminating components and/or manufacturing steps may reduce the complexity and/or cost involved in manufacturing the lighting assemblies.

BRIEF DESCRIPTION OF THE INVENTION

In one embodiment, a lighting device is provided. The device includes an outer assembly, a light emitting device, and a contact. The outer assembly extends between a base end and an opposite light emitting end along a longitudinal axis. The outer assembly includes a contact carrier sub-assembly that extends from the base end to an outer end disposed proximate to the light emitting end. The light emitting device is disposed proximate to the light emitting end of the outer assembly. The light emitting device is configured to generate and emit light from the light emitting end. The contact is held in the contact carrier sub-assembly and extends from the base end of the outer assembly to the outer end of the contact carrier sub-assembly. The contact is electrically coupled with the light emitting device to provide a continuous electrically conductive path from the base end of the outer assembly to the outer end of the contact carrier sub-assembly. The contact is configured to supply electric current to the light emitting device.

In another embodiment, another lighting device is provided. The device includes a heat sink, a light emitting device, a contact carrier sub-assembly, a contact and an optical lens. The heat sink extends from a base end to an opposite light emitting end along a longitudinal axis. The base end is configured to mount the heat sink to an external device. The light emitting device is disposed proximate to the light emitting end of the heat sink and is configured to emit light out of the light emitting end. The contact carrier sub-assembly is secured to the heat sink and extends from the base end of the heat sink to an outer end disposed proximate to the light emitting device. The contact is held in the contact carrier sub-assembly and extends from the base end of the heat sink to the outer end of the contact carrier sub-assembly. The contact is configured to supply electric current to the light emitting device from the external device. The optical lens is located between the light emitting device and the light emitting end of the heat sink. The optical lens is configured to transmit light generated by the light emitting device through the light emitting end. The contact carrier subassembly and the optical lens are secured to the heat sink by snap-fit connections. Alternatively, the contact carrier sub-assembly and/or the optical lens are secured to the heat sink by a different mechanical coupling, such as by using additional hardware, welding, ultrasonic welding, or thermoplastic or heat staking.

DETAILED DESCRIPTION OF THE INVENTION

Figure 1:
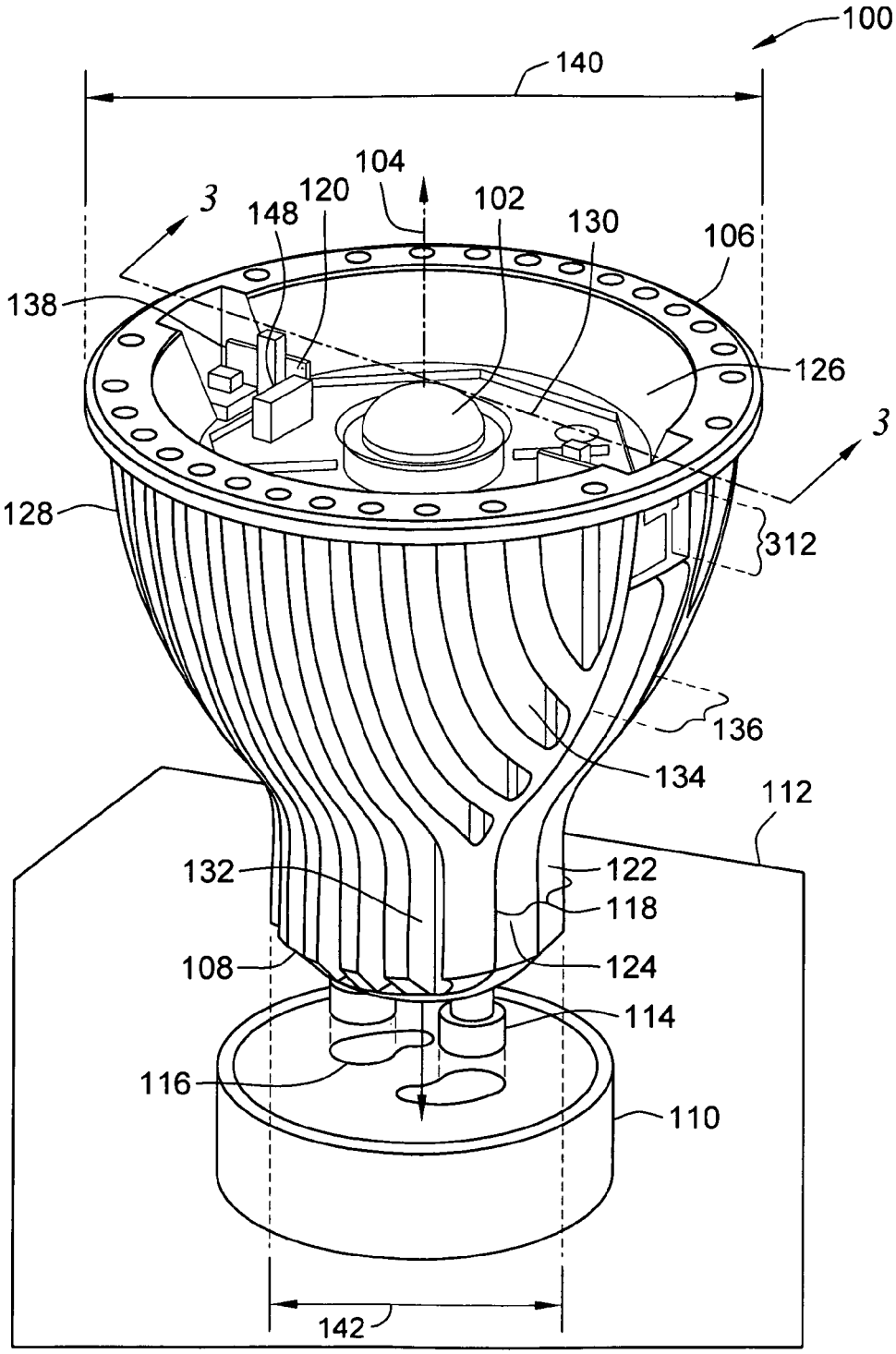
FIG. 1 is a perspective view of a lighting device in accordance with one embodiment.

FIG. 1 is a perspective view of a lighting device 100 in accordance with one embodiment. The device 100 includes a light emitting device 102 that generates light generally along a longitudinal axis 104 of the device 100. In the illustrated embodiment, the light emitting device 102 is a light emitting diode (LED) that is mounted to a substrate 130. For example, the light emitting device 102 may be an Acriche® LED that is manufactured by Seoul Semiconductor, Inc. and that receives alternating current to generate light. Alternatively, the light emitting device 102 may be driven by direct current to generate light. The substrate 130 may be a circuit board that includes conductive traces or contacts that are electrically coupled with the light emitting device 102. Alternatively, a different light emitting device 102 may be used in place of an LED.

The device 100 includes an outer assembly 128 that extends from a base end 108 to a light emitting end 106 along the longitudinal axis 104. The base end 108 is disposed opposite the light emitting end 106. In the illustrated embodiment, the outer assembly 128 has a funnel shape. For example, a diameter dimension 140 of the outer assembly 128 may be the greatest at the light emitting end 108 and gradually decrease to a smaller diameter dimension 142 at or near the base end 108. The diameter dimensions 140, 142 are measured in directions that are perpendicular to the longitudinal axis 104 in the illustrated embodiment. Alternatively, the outer assembly 128 may have a different shape.

The light generated by the light emitting device 102 emanates from the light emitting end 106 away from the base end 108. The base end 108 may be mounted to a mounting device 110 which is secured to an external device, such as a substrate 112. The substrate 112 may include a circuit board, for example. In the illustrated embodiment, the mounting device 110 is a GU10-compatible socket, such as a ceramic GU10 halogen lamp socket. The mounting device 110 may supply an alternating electric current, or AC current, to the device 100 in order to activate and power the light emitting device 102. Alternatively, a different mounting device 110 is used to mount the device 100 to the substrate 112. For example, the device 100 may be configured to mate with a non-GU10 compatible socket. In another embodiment, the device 100 may be directly mounted to the substrate 112 by mounting the base end 108 to the substrate 112. The mounting device 110 electrically couples the device 100 to the substrate 112. The substrate 112 provides electric power to the light emitting device 102. Alternatively, the mounting device 110 may be joined with another electrical component (not shown) to provide power to the light emitting device 102 from the electrical component. For example, the mounting device 110 may be electrically coupled with wires, wire leads, and/or connectors that supply power to the light emitting device 102.

The device 100 includes a pair of mounting posts 114 protruding from the base end 108 of the outer assembly 128. Alternatively, a different number of mounting posts 114 may be provided. The mounting posts 114 extend from the base end 108 in directions that are approximately parallel to the longitudinal axis 104. The mounting posts 114 include or are formed from a conductive material. For example, the mounting posts 114 may be machined from a metal or metal alloy. In another example, the mounting posts 114 may include or be formed from a dielectric material that is at least partially plated with a conductive material. The mounting posts 114 are received in cavities 116 of the mounting device 110 to mount the device 100 to the mounting device 110 and to establish a conductive pathway between the device 100 and the mounting device 110.

In the illustrated embodiment, the outer assembly 128 is a heat sink that is joined with a contact carrier sub-assembly 118. The outer assembly 128 conducts or communicates thermal energy created by the light emitting device 102 to the exterior surface of the outer assembly 128. For example, the light emitting device 102 and/or the substrate 130 generates thermal energy during the generation of light. The thermal energy is conducted from the light emitting device 102 and/or the substrate 130 to the outer assembly 128. The outer assembly 128 communicates the thermal energy to the exterior surfaces of the outer assembly 128 such that at least some of the thermal energy is dissipated into the surrounding atmosphere.

In the illustrated embodiment, the outer assembly 128 includes, several ribs 132 along the exterior surface of the outer assembly 128. The ribs 132 are elongated and extend along the exterior surface of the outer assembly 128 from the light emitting end 106 of the outer assembly 128 toward the base end 108. The ribs 132 are oriented approximately parallel to one another along the exterior surface of the outer assembly 128. Alternatively, the ribs 132 may be shaped and/or oriented differently from the embodiment shown in FIG. 1. The ribs 132 are separated from one another by channels 134 in the outer assembly 128. The channels 134 are recessed portions of the outer assembly 128 located between the ribs 132. The ribs 132 and channels 134 may increase the surface area of the exterior of the outer assembly 128. Increasing the surface area of the exterior of the outer assembly 128 may increase the thermal energy that is dissipated by the outer assembly 128 into the surrounding atmosphere.

The contact carrier sub-assembly 118 is held in the outer assembly 128. As shown in FIG. 1, the contact carrier sub-assembly 118 is received in the gap 136. In the illustrated embodiment the contact carrier sub-assembly 118 includes a pair of substantially identical contact carrier sections 122, 124. The contact carrier sub-assembly 118 holds contacts 200, 202 (shown in FIG. 2) that provide electrically conductive pathways in the contact carrier sub-assembly 118. The contacts 200, 202 are coupled with bridge contacts 120 in locations proximate to the light emitting end 106 of the device 100. The bridge contacts 120 provide an electrically conductive path that bridges the gap between the contacts 200, 202 and the substrate 130 to which the light emitting device 102 is mounted. The contacts 200, 202 and bridge contacts 120 provide an electrically conductive pathway between the mounting posts 114 and the light emitting device 102.

An optical lens 126 is disposed at or proximate to the light emitting end 106 of the outer assembly 128 in the illustrated embodiment. The optical lens 126 is a unitary, light transmissive body that transmits light generated from the light emitting device 102 out of the device 100. The optical lens 126 includes or is formed from a light transmissive material that may refract the light generated by the light emitting device 102. For example, the optical lens 126 may be formed from an acrylic material that refracts the light in one or more of a variety of light distribution patterns. The optical lens 126 includes slots 138 that extend into the unitary body of the optical lens 126. The slots 138 are shaped to receive the bridge contacts 120. As described below, the bridge contacts 120 are loaded into the slots 138 to secure the bridge contacts 120 in the optical lens 126. A ledge 148 is disposed adjacent to each of the slots 138 in the optical lens 126. The ledges 148 are internal surfaces next to the slots 138 that provide surfaces for the bridge contacts 120 to engage. For example, the bridge contacts 120 engage the ledges 148 to prevent the bridge contacts 120 from being removed from the optical lens 126, as described below.

Figure 2:
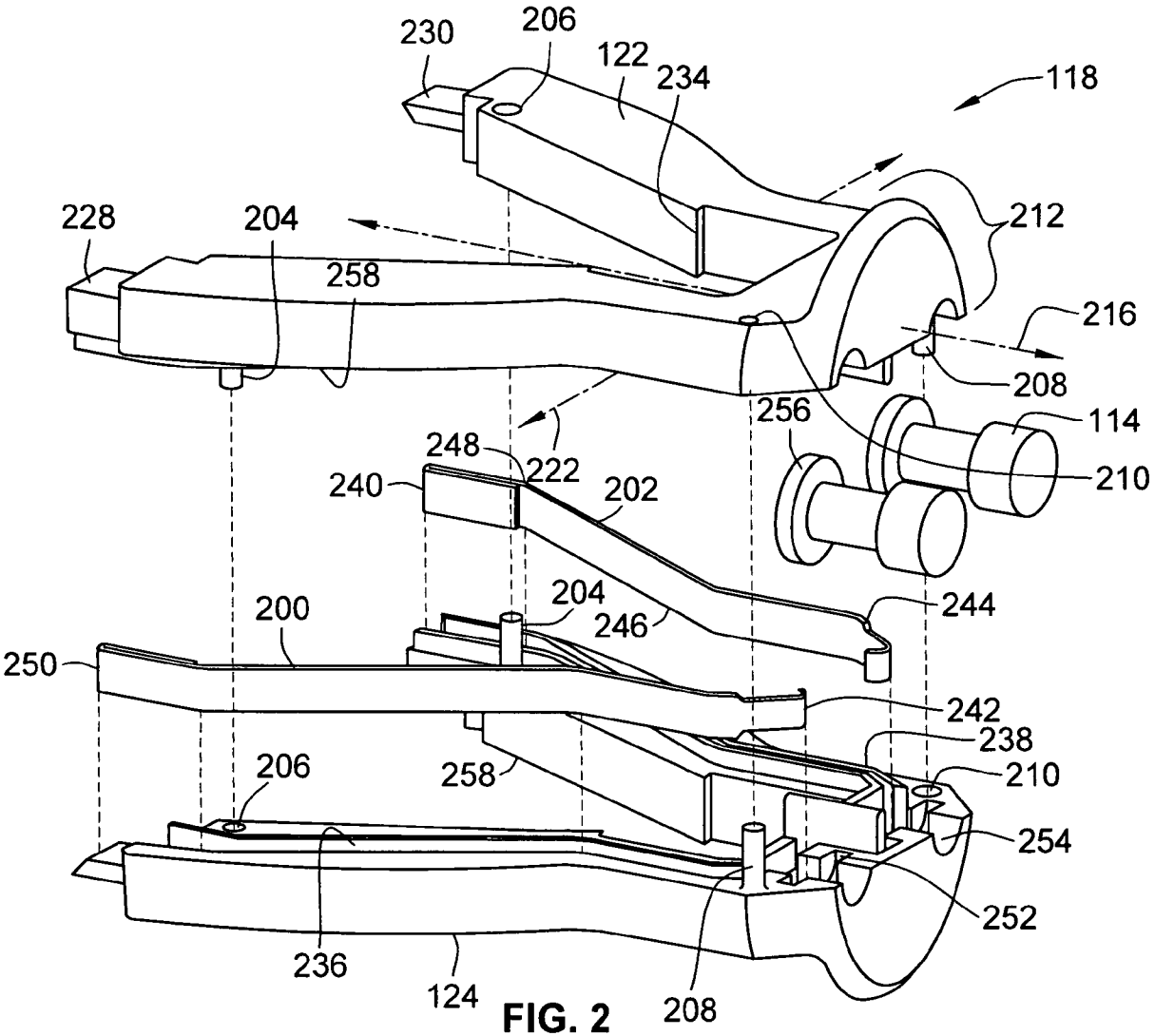
FIG. 2 is an exploded view of a contact carrier sub-assembly shown in FIG. 1 in accordance with one embodiment.

FIG. 2 is an exploded view of the contact carrier subassembly 118 in accordance with one embodiment. In the illustrated embodiment, the two contact carrier sections 122, 124 are substantially identical to one another. For example, the contact carrier sections 122, 124 may be molded dielectric components that are formed using the same or substantially similar molds. Alternatively, the contact carrier sections 122, 124 may have different shapes and/or dimensions. Each of the contact carrier sections 122, 124 has a V- or U-shape that is oriented along a corresponding longitudinal axis 216. Alternatively, the contact carrier sections 122, 124 may have a different shape. The longitudinal axes 216 of the contact carrier sections 122, 124 are substantially parallel to the longitudinal axis 104 (shown in FIG. 1) of the device 100 (shown in FIG. 1) when the contact carrier sections 122, 124 are assembled into the device 100.

Each contact carrier section 122, 124 includes alignment features to align the contact carrier sections 122, 124 with respect to one another. By way of example only, each contact carrier section 122, 124 may include an upper alignment pin 204, an upper alignment cavity 206, a lower alignment pin 208, and a lower alignment cavity 210. The upper alignment pin 204 of the contact carrier section 122 is received in the upper alignment cavity 206 of the contact carrier section 124. The upper alignment pin 204 of the contact carrier section 124 is received in the upper alignment cavity 206 of the contact carrier section 122. The lower alignment pin 208 of the contact carrier section 122 is received in the lower alignment cavity 210 of the contact carrier section 124. The lower alignment pin 208 of the contact carrier section 124 is received in the lower alignment cavity 210 of the contact carrier section 122. The contact carrier sections 122, 124 may mate with one another and be secured together by a snap-fit connection between the alignment pins 204, 208 and the alignment cavities 206, 210. In one embodiment, the contact carrier sections 122, 124 engage one another to form the contact carrier sub-assembly 118 as shown in FIG. 1 without the use of additional securing components or mechanisms. For example, the contact carrier sections 122, 124 may be fastened together through a snap-fit connection without the use of additional latches, adhesives, and the like. Alternatively, one or more securing components, such as latches, adhesives, heat staking, ultrasonic welding, and the like, can be used to secure the contact carrier sections 122, 124 together.

Each of the contact carrier sections 122, 124 includes cantilevered beams 258 that are angled away from one another and from the longitudinal axis 216 in the illustrated embodiment. The cantilevered beams 258 extend from a base portion 212 of the contact carrier sections 122, 124 to outer ends 228, 230. Opposing engagement shoulders 234 are disposed at the intersection between the transition portion 218 and the upper portion 226. The engagement shoulders 234 are ledges of the contact carrier sections 122, 124 that extend toward one another between the parallel beams 220.

Contact trenches 236, 238 are disposed in the contact carrier sections 122, 124. In the illustrated embodiment, each contact carrier section 122, 124 has both of the contact trenches 236, 238. Alternatively, one or more of the contact carrier sections 122, 124 may have only one of the contact trenches 236, 238. For example, the contact carrier section 122 may include the contact trench 236 and not the contact trench 238 while the contact carrier section 122 has the contact trench 238 but not the contact trench 236. The contact trenches 236, 238 are recesses in the contact carrier sections 122, 124 that form channels extending along the length of the beams 220.

The contact trenches 236, 238 are shaped to receive the contacts 200, 202. The contacts 200, 202 may be enclosed within the contact carrier sub-assembly 118 when the contact carrier subassembly 118 is received in the device 100 (shown in FIG. 1). In the illustrated embodiment, the contacts 200, 202 are enclosed in the contact carrier sub-assembly 118 such that no conductive part or section of the contacts 200, 202 are exposed on the exterior of the device 100. For example, the contact carrier sub-assembly 118 may electrically isolate the contacts 200, 202 from the outer assembly 128. Enclosing the contacts 200, 202 within the contact carrier sub-assembly 118 and/or device 100 may prevent electrical shorting of the contacts 200, 202, electric shock and/or injury to operators of the device 100 when electric current, such as AC current, is supplied through the contacts 200, 202 to power the lighting device 102.

As shown in FIG. 2, the contacts 200, 202 are elongated between mating ends 240 and mounting ends 242. The contacts 200, 202 are stamped and formed contacts in the illustrated embodiment. For example, each of the contacts 200, 202 may be stamped and formed from a common sheet of conductive material, such as a metal. The contacts 200, 202 are formed by bending the conductive material after cutting the contacts 200, 202 from the sheet of conductive material. For example, each contact 200, 202 includes bends 244-250 that form the contacts 200, 202 in the shapes shown in FIG. 2. Alternatively, the contacts 200, 202 may include a different number of bends 244-250. The bends 244-250 form the contacts 200, 202 in shapes to enable the contacts 200, 202 to be received into and fit in the contact trenches 236, 238. The bend 250 at or near the mating end 240 folds the contacts 200, 202 back onto themselves. For example, the bends 250 fold the contacts 200, 202 over to increase a thickness of the contacts 200, 202 proximate to the mating ends 240 relative to the remainder of the contacts 200, 202.

The base portions 212 of the contact carrier sections 122, 124 include cavities 252 and openings 254 that are shaped to receive the mounting posts 114 and to permit the mounting posts 114 to protrude through the mounting surface 214. The mounting posts 114 have a cylindrical shapes that are elongated in directions disposed parallel to the longitudinal axes 216 with a flange 256 disposed at one end of each post 114. The cavities 252 are shaped to receive the flanges 256. For example, the cavities 252 may be elongated slots that receive the flanges 256. The flanges 256 are received into the cavities 252 with a portion of the mounting posts 114 protruding through the mounting surface 214. The mounting posts 114 include or are formed from a conductive material. For example, the mounting posts 114 may be machined from metal stock. Alternatively, the mounting posts 114 may be formed from a dielectric material and plated with a conductive material.

Figure 3:
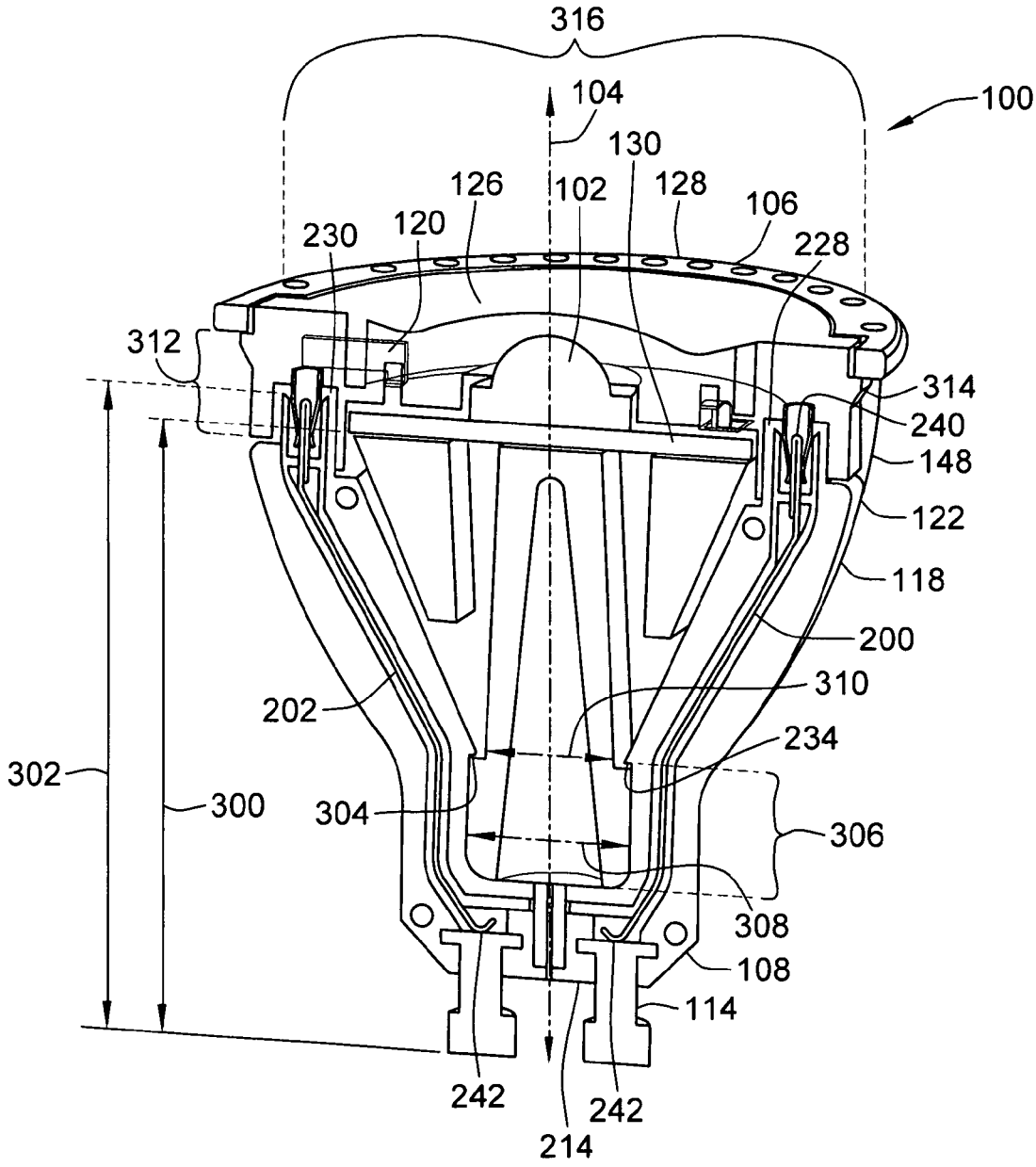
FIG. 3 is a cross-sectional view of the device shown in FIG. 1 along line 3-3 in FIG. 1.

FIG. 3 is a cross-sectional view of the device 100 taken along line 3-3 in FIG. 1. In the illustrated embodiment, the cross-sectional view only shows the contact carrier section 122 of the contact carrier sub-assembly 118. The mounting ends 242 of the contacts 200, 202 engage the mounting posts 114 to electrically couple the contacts 200, 202 with the mounting posts 114. The contacts 200, 202 may engage the mounting posts 114 within the contact carrier sub-assembly 118 by positioning the contacts 200, 202 in direct contact with the mounting posts 114. In another embodiment, one or more additional conductive components may be provided between the mounting posts 114 and the contacts 200, 202 to establish a conductive pathway between each contact 200, 202 and one of the mounting posts 114. Alternatively, the contacts 200, 202 may be soldered or otherwise terminated to the mounting posts 114.

The mating ends 240, 250 of the contacts 200, 202 mate with the bridge contacts 120 that are held in the optical lens 126. The contacts 200, 202 provide an electrically conductive pathway between the mounting posts 114 and the bridge contacts 120 to permit power to be supplied to the light emitting device 102 from the substrate 112 (shown in FIG. 1). In one embodiment, the contacts 200, 202 provide a direct conductive path that extends from the base end 108 of the outer assembly 128, through the outer assembly 128 along the longitudinal axis 104 and up to the light emitting device 102. The light emitting device 102 is mounted to the substrate 130 proximate to the light emitting end 106. For example, the light emitting device 102 and substrate 130 are disposed in the outer assembly 128 in a position that is closer to the light emitting end 106 than the base end 108. The light emitting device 102 and substrate 130 are separated from the mounting surface 214 of the base end 108 along the longitudinal axis 104 by a first height dimension 300. The first height dimension 300 may represent the shortest distance between the light emitting device 102 or substrate 130 and the mounting surface 214. For example, the bottom surface of the substrate 130 to which the light emitting device 102 is mounted is separated from the mounting surface 214 by the first height dimension 300. The first height dimension 300 is measured in a direction that is along or parallel to the longitudinal axis 104.

The contacts 200, 202 continuously extend through the outer assembly 128 and the contact carrier sub-assembly 118 to a height that is at least as great as the first height dimension 300. For example, each of the contacts 200, 202 is a unitary body that extends from proximate to the mounting surface 214 in the base end 108 to a second height dimension 302. The second height dimension 302 may represent the greatest distance between the mounting surface 214 and the mating ends 240 of the contacts 200, 202 in a direction along the longitudinal axis 104. For example, the second height dimension 302 may be measured in a direction along or parallel to the longitudinal axis 104. As shown in FIG. 3, the second height dimension 302 is larger than the first height dimension 300. Alternatively, the second height dimension 302 may be the same size as, or smaller than, the first height dimension 300. For example, the contacts 200, 202 may continuously extend to a location in the outer assembly 128 that is below the light emitting device 102 and substrate 130. The bridge contacts 120 may extend farther down in the outer assembly 128 to be coupled with the contacts 200, 202 in such an embodiment. Alternatively, one or more additional contacts (not shown) may electrically join the contacts 200, 202 and the bridge contacts 120.

In the illustrated embodiment, the contacts 200, 202 continuously extend through the contact carrier subassembly 118 from the base end 108 to the second height dimension 302 in order to provide a direct conductive pathway between the base end 108 and the outer ends 228, 230 of the contact carrier section 122. The contacts 200, 202 extend through the contact carrier sub-assembly 118 without terminating to or coupling with additional intervening electrical components such as, by way of example only, additional circuit boards (not shown), LED drivers (not shown), thermal protection components (not shown), circuit protection components (not shown), and the like. For example, the contacts 200, 202 may extend through the contact carrier sub-assembly 118 to the substrate 130 without connecting with any additional intervening components between the base end 108 and the first height dimension 300.

The bridge contacts 120 electrically join the contacts 200, 202 with the light emitting device 102. The mounting posts 114, contacts 200, 202 and bridge contacts 120 provide an electrically conductive path that directly extends from the base end 108 to the light emitting device 102. The conductive path in the illustrated embodiment includes only conductive contacts and does not include any other electrical components. Using the contacts 200, 202 to directly couple the light emitting device 102 with the source of power to the light emitting device 102, such as the substrate 112 (shown in FIG. 1), may reduce the complexity and cost of manufacturing the device 100, as fewer components are included in the device 100.

Several components of the device 100 may be secured together by snap-fit or interference connections. The snap-fit connections between the components may secure the various components together without the use of adhesives such as solder or thermal adhesives. The snap-fit connections may reduce the cost and complexity of assembling the device 100. As described above, the contact carrier sections 122, 124 may be joined together via a snap-fit connection. The outer assembly 128 includes an internal shoulder 304 that engages the engagement shoulders 234 of the contact carrier sections 122, 124. The outer assembly 128 includes a lower end 306 that is loaded into the contact carrier sub-assembly 118 between the parallel beams 220 of the contact carrier sections 122, 124. The lower end 306 of the outer assembly 128 has a width dimension 308 that is measured in a direction that is perpendicular to the longitudinal axis 104. For example, the width dimension 308 may be measured in a direction that is parallel to the lateral axis 222 of the contact carrier sub-assembly 118. The width dimension 308 of the lower end 306 of the outer assembly 128 is greater than a separation dimension 310 between the engagement shoulders 234 of the contact carrier sub-assembly 118. The separation dimension 310 is the distance between the engagement shoulders 234 that is measured in a direction parallel to or along the lateral axis 222. The lower end 306 is pressed into the contact carrier sub-assembly 118 between the engagement shoulders 234 of the contact carrier subassembly 118 until the internal shoulder 304 of the outer assembly 128 passes the engagement shoulders 234. Once the internal shoulder 304 of the outer assembly 128 is loaded into the contact carrier sub-assembly 118 past the engagement shoulders 234, the internal shoulder 304 of the outer assembly 128 and the engagement shoulders 234 of the contact carrier sub-assembly 118 engage one another in a snap-fit connection to prevent removal of the outer assembly 128. For example, the internal shoulder 304 contacts the engagement shoulders 234 to prevent removal of the outer assembly 128 from the contact carrier sub-assembly 118 in a direction along the longitudinal axis 104 and away from the base end 108.

The optical lens 126 and outer assembly 128 may be secured together using a snap-fit connection. The outer assembly 128 includes an upper opening 316 disposed proximate to the light emitting end 106 of the device 100. Light generated by the light emitting device 102 emanates from the device 100 through the upper opening 316. The optical lens 126 includes latches 314 that laterally extend from opposite sides of the optical lens 126. For example, the latches 314 protrude from the optical lens 126 in opposite directions in the illustrated embodiment. The optical lens 126 is loaded into the upper opening 316 with the latches 314 inserted into lateral openings 312 of the outer assembly 128. Once the latches 314 are loaded into the lateral openings 312, the latches 314 engage the outer assembly 128 to secure the optical lens 126 to the outer assembly 128.

Alternatively, several components of the device 100 may be secured together in another manner. For example, two or more components of the device 100 may be screwed together, joined using external hardware (such as a latch, for example), ultrasonically welded together, and the like. In one embodiment, the outer assembly 128 is secured to the contact carrier subassembly 118 through a threaded interface. For example, one of the outer assembly 128 and the contact carrier sub-assembly 118 may have a threaded surface while the other includes grooves configured to receive the threaded surface.

The outer assembly 128 and contact carrier sub-assembly 118 are then screwed together to secure the outer assembly 128 and the contact carrier sub-assembly 118 to one another. In another embodiment, the optical lens 126 and the outer assembly 128 are screwed together. One of the optical lens 126 and the outer assembly 128 may include a threaded surface while the other includes matching grooves that permit the optical lens 126 and outer assembly 128 to be screwed together.

Figure 4:
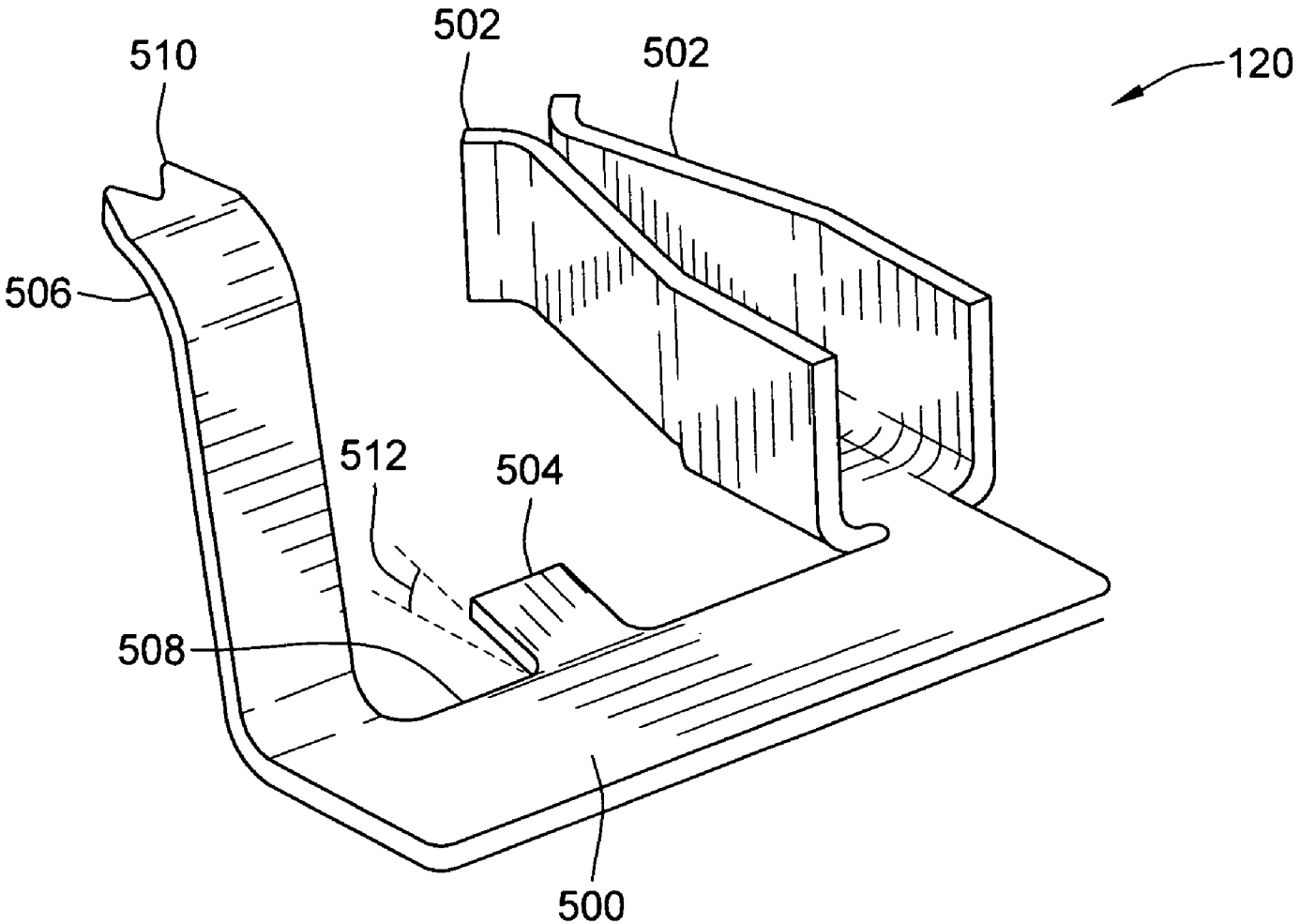
FIG. 4 is a perspective view of a bridge contact shown in FIG. 1.

FIG. 4 is a perspective view of the bridge contact 120 in accordance with one embodiment. The bridge contact 120 is stamped and formed from a common sheet of a conductive material, such as a metal. Alternatively, the bridge contact 120 may be a dielectric body that is at least partially plated with a conductive material. The bridge contact 120 includes an elongated carrier strip 500. The carrier strip 500 may be a substantially planar body in a rectangular shape. The carrier strip 500 interconnects mating fingers 502, a securing tab 504, and a mating beam 506. In the illustrated embodiment, the mating fingers 502, securing tab 504, and mating beam 506 are joined to a common edge 508 of the carrier strip 500.

The mating fingers 502 oppose one another and are angled toward each other. As shown in FIG. 3, the mating end 240 (shown in FIG. 2) of the contacts 200, 202 (shown in FIG. 2) is received between the mating fingers 502 to electrically couple the bridge contact 120 with the contact 200 or 202. The loading of the mating end 240 between the mating fingers 502 may slightly bias the mating fingers 502 away from one another.

The mating beam 506 extends from the carrier strip 500 to an outer mating end 510. In the illustrated embodiment, the mating end 510 is a forked tongue. Alternatively, the mating end 510 may have a different shape. The mating end 510 engages a contact or contact pad (not shown) of the substrate 130 (shown in FIG. 1) to which the light emitting device 102 (shown in FIG. 1) is mounted. The mating end 510 electrically couples the bridge contact 120 with the substrate 130 and light emitting device 102. Electric current supplied through the contact 200 or 202 (shown in FIG. 2) may be communicated to the light emitting device 102 and the substrate 130 through the mating fingers 502, the carrier strip 500 and the mating beam 506.

The securing tab 504 is joined to the carrier strip 500 between the mating fingers 502 and the mating beam 506 in the illustrated embodiment. Alternatively, the securing tab 504 may be disposed in another location relative to the mating fingers 502 and mating beam 506. The securing tab 504 is angled away from the plane defined by the carrier strip 500 by a deflection angle 512. The bridge contact 120 is held within the slot 138 (shown in FIG. 1) in the optical lens 126 (shown in FIG. 1). As the carrier strip 500 is loaded into the slot 138, the securing tab 504 is biased toward the plane defined by the carrier strip 500. When the carrier strip 500 is loaded sufficiently far into the slot 138 such that the securing tab 504 passes the ledge 148 (shown in FIG. 1) that is adjacent to the slot 138, the securing tab 504 may become unbiased and return to the position shown in FIG. 4. The securing tab 504 engages the ledge 148 of the optical lens 126 to prevent the bridge contact 120 from being removed from the optical lens 126.

Figure 5:
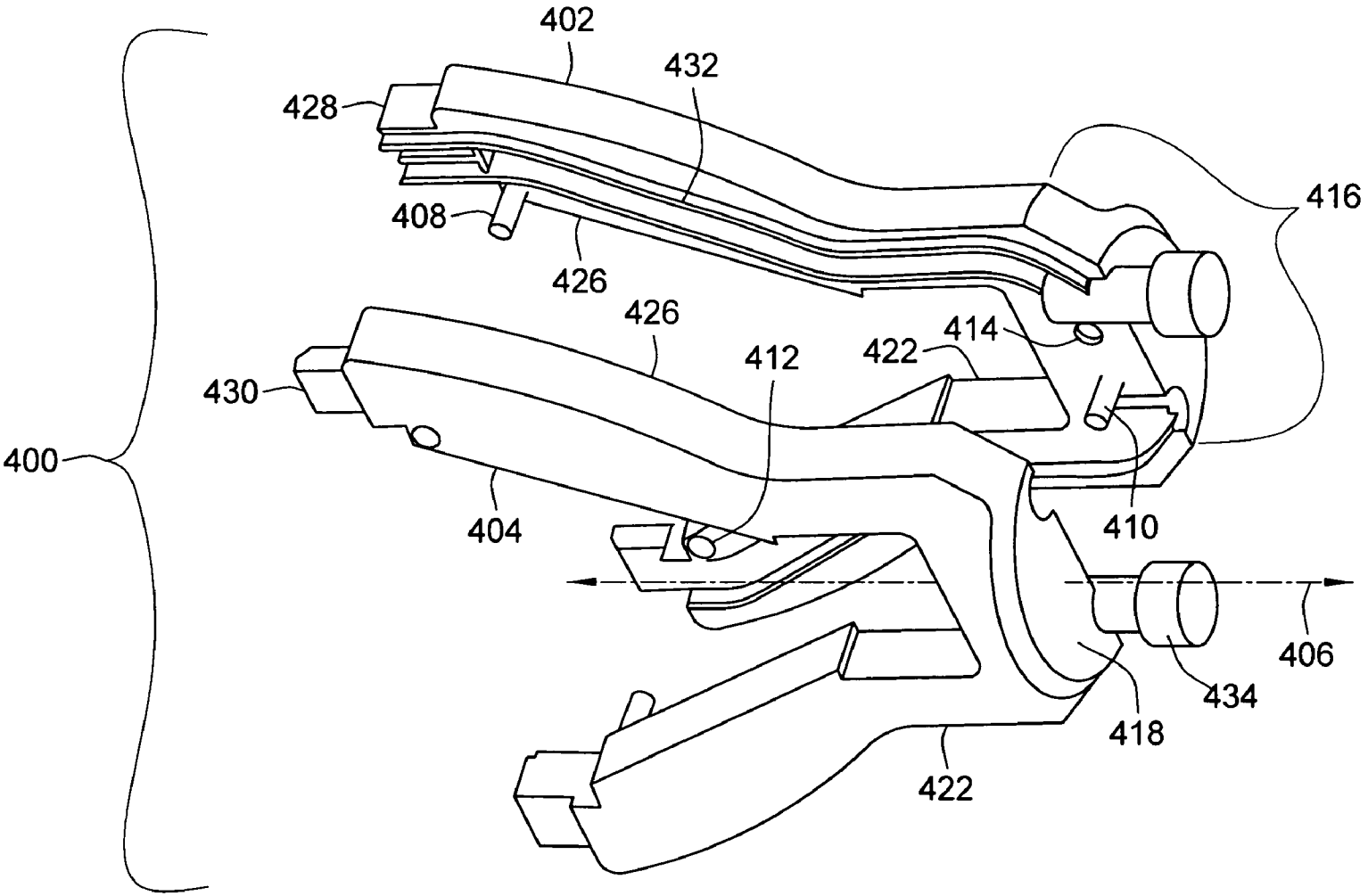
FIG. 5 is an exploded view of a contact carrier sub-assembly according to an alternative embodiment.

FIG. 5 is an exploded view of a contact carrier subassembly 400 according to an alternative embodiment. The contact carrier sub-assembly 400 may be used in the device 100 (shown in FIG. 1) in place of the contact carrier sub-assembly 118 (shown in FIG. 1). For example, the contact carrier sub-assembly 400 may be joined with the outer assembly 128 (shown in FIG. 1). The contact carrier sub-assembly 400 in the illustrated embodiment includes two contact carrier sections 402, 404. Similar to the contact carrier sections 122, 124 (shown in FIG. 1), the contact carrier sections 402, 404 may be substantially identical to one another, with the same dimensions, size, and the like. Alternatively, the contact carrier sections 402, 404 may differ in size, shape and/or dimensions from one another. Each of the contact carrier sections 402, 404 has an approximate V- or U-shape that is oriented along a corresponding longitudinal axis 406 in the illustrated embodiment. Similar to the contact carrier sections 122, 124, the contact carrier sections 402, 404 include alignment features to align the contact carrier sections 402, 404 with respect to one another. The alignment features include alignment pins 408, 410 and alignment cavities 412, 414 in each contact carrier section 402, 404. Similar to as described above, the alignment pins 408, 410 are received in the corresponding alignment cavities 412, 414. The contact carrier sections 402, 404 mate with one another and may be secured together by a snap-fit connection. Alternatively, one or more securing components, such as latches, adhesives, and the like, are used to secure the contact carrier sections 402, 404 together.

The contact carrier sections 402, 404 include base portions 416 located at or proximate to the base end 108 (shown in FIG. 1) of the outer assembly 128 (shown in FIG. 1). The base portions 416 include mounting surfaces 418 that engage the mounting device 110 (shown in FIG. 1) or substrate 112 (shown in FIG. 1) when the device 100 is mounted to the mounting device 110 or substrate 112. Each contact carrier section 402, 404 includes cantilevered beams 426 that are similar to the cantilevered beams 258 (shown in FIG. 2). The cantilevered beams 426 extend to outer ends 428, 430 that are similar to the outer ends 228, 230 (shown in FIG. 2).

A contact path 432 extends along one side of each contact carrier section 402, 404. For example, the contact path 432 may be disposed in one of the beams 426 between the base portion 416 to the outer end 428. Alternatively, the contact path 432 may extend from the base portion 416 to the outer end 430. The contact path 432 is shown in the illustrated embodiment as a channel recessed into the contact carrier sections 402, 404. The contact path 432 is selectively plated with a conductive material. For example, the contact carrier sections 402, 404 may be molded interconnect devices that are separately molded from dielectric materials and selectively plated with conductive materials to create the contact paths 432. The contact path 432 in each contact carrier section 402, 404 may include or be formed from copper. In one embodiment, the contact path 432 may be doped or sputtered with one or more dopants or adhesive materials that assist in affixing the conductive plating material to the dielectric of the contact carrier section 402, 404.

The contact path 432 includes a mounting post 434 disposed at proximate to the base portion 416 and that is shaped similar to the mounting post 114 (shown in FIG. 1). In the illustrated embodiment, the base portion 416 of each contact carrier section 402, 404 includes a single mounting post 434 that is integrally molded with the corresponding contact carrier section 402, 404. For example, the mounting post 434 and contact carrier section 402 may be molded as a unitary body of dielectric material. The contact path 432 extends to the mounting post 434. Similar to the contact path 432, the mounting post 434 may be selectively plated with a conductive material, such as copper or other conductive material. Plating the mounting post 434 and the contact path 432 establishes a unitary conductive pathway that may extend from the mounting post 434 to the outer end 428 of each contact carrier section 402, 404. For example, the conductive pathways in the contact carrier sections 402, 404 may continuously extend from the base portion 416 to the outer ends 428 without coupling the contact path 432 and/or mounting post 434 to any other intervening contacts or components. Using the housing 400 instead of the contact carrier sub-assembly 118 (shown in FIG. 1) may reduce the complexity of manufacturing the device 100 (shown in FIG. 1). For example, as the mounting post 434, contact path 432 and contact carrier sections 402, 404 may be molded as unitary bodies with plating selectively applied thereon, the number of components in the contact carrier sub-assembly 400 may be reduced when compared to the contact carrier sub-assembly 118.

The contact paths 432 may be inaccessible outside of the outer assembly 128 (shown in FIG. 1) when the outer assembly 148 is mounted to the mounting device 110 (shown in FIG. 1) or substrate 112 (shown in FIG. 1). For example, the portion of the contact paths 432 located within the contact carrier sections 402, 404 may be enclosed within the contact carrier subassembly 400 when the contact carrier sections 402, 404 are joined together. The mounting posts 434 may be located within the mounting device 110 and/or substrate 112 when the outer assembly 148 is mounted to the mounting device 110 or substrate 112. As described above, enclosing the conductive contact paths 432 within the contact carrier subassembly 118, mounting device 110, and/or substrate 112 may prevent electric shock and/or injury to operators of the device 100 when electric current, such as AC current, is supplied through the contact paths 432 to power the lighting device 102.

Figure 6:
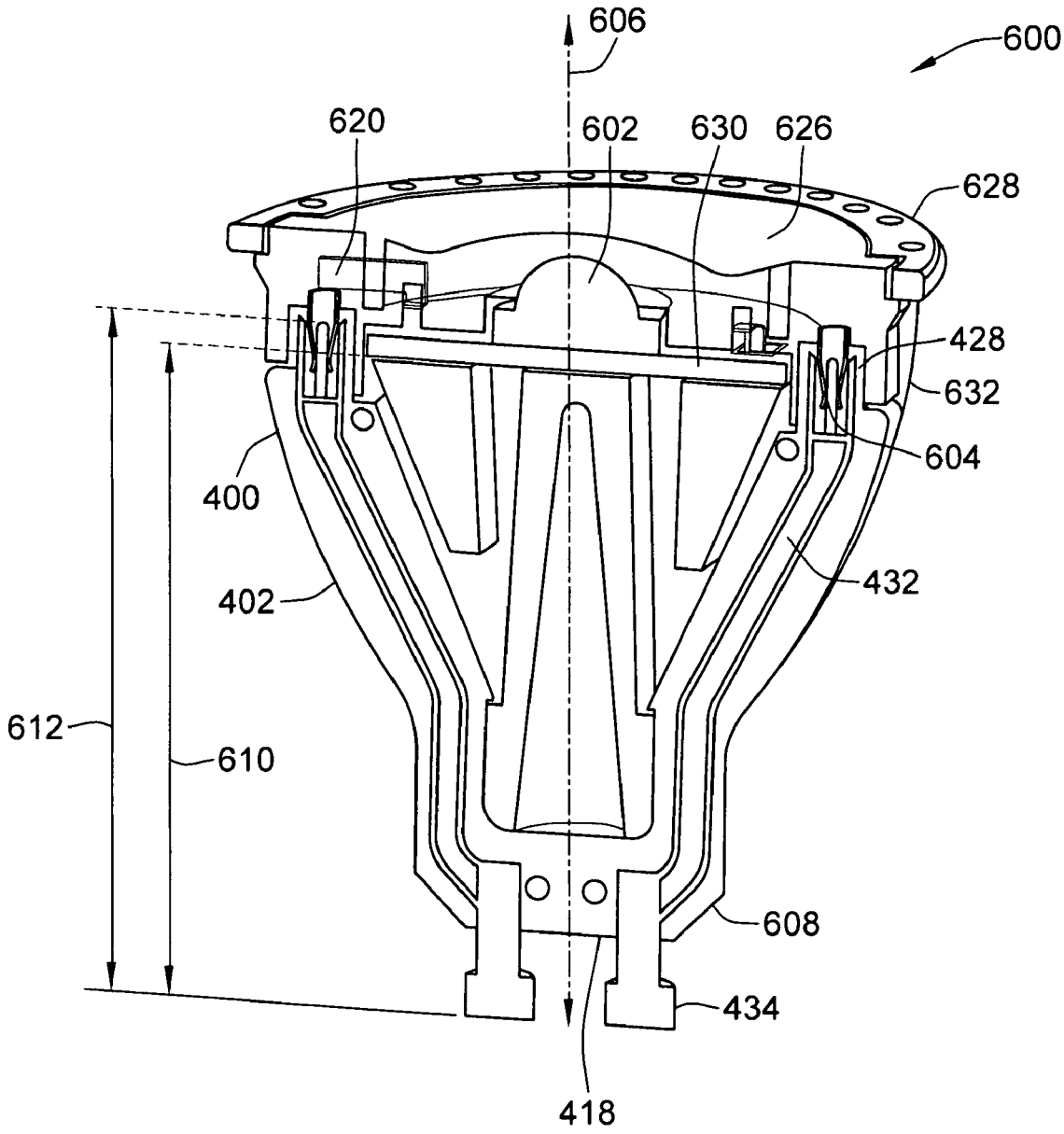
FIG. 6 is a cross-sectional view of a lighting device in accordance with another embodiment.

FIG. 6 is a cross-sectional view of a lighting device 600 in accordance with another embodiment. The device 600 may be similar to the device 100 (shown in FIG. 1). For example, the device 600 includes an outer assembly 632 that is similar to the outer assembly 128 (shown in FIG. 1). The outer assembly 632 is oriented along a longitudinal axis 606 similar to the longitudinal axis 104 (shown in FIG. 1) and includes a light emitting device 602 that is similar to the light emitting device 102 (shown in FIG. 1), a substrate 630 that is similar to the substrate 130 (shown in FIG. 1), an optical lens 626 that is similar to the optical lens 126 (shown in FIG. 1), bridge contacts 620 that are similar to the bridge contacts 120 (shown in FIG. 1), and a base end 608 that is similar to the base end 108 (shown in FIG. 1).

One difference between the device 600 and the device 100 (shown in FIG. 1) is the inclusion of the contact carrier sub-assembly 400 in the device 600. While only the contact carrier section 402 is visible in FIG. 6, the other contact carrier section 404 (shown in FIG. 5) may be secured to the contact carrier section 402 to form the contact carrier sub-assembly 400. The contact path 432 in each of the contact carrier sections 402, 404 includes a mating tab 604 disposed proximate to the outer end 428 of the contact carrier section 402, 404. The mating tab 604 is plated with a conductive material in a manner similar to the contact path 432. The mating tab 604 engages the bridge contact 620 to electrically couple the bridge contact 620 with the contact path 432. The plated mounting post 434 is mounted to the mounting device 110 (shown in FIG. 1) or substrate 112 (shown in FIG. 1) to electrically couple the mounting device 110 or substrate 112 with the mounting post 434 and the contact path 432.

Similar to the contacts 200, 202 (shown in FIG. 2), in one embodiment, the plated portions of the contact carrier subassembly 400, including the plated mounting post 434, the contact path 432 between the mounting post 434 and mating tab 604, and the mating tab 604, provide continuous, direct conductive paths that extend from the base end 608 along the longitudinal axis 606 to the light emitting device 602. Similar to the light emitting device 102 (shown in FIG. 1) and substrate 130 (shown in FIG. 1), the light emitting device 602 and substrate 630 are separated from the mounting surface 418 of the base end 608 along the longitudinal axis 606 by a first height dimension 610.

The contact path 432 provides an electrically conductive pathway through the contact carrier subassembly 400 from the base end 608 to the light emitting device 602 via the bridge contacts 620. In a manner similar to the contacts 200, 202, the contact path 432 in each contact carrier section 402, 404 provides a continuous, direct conductive pathway between the base end 608, through the contact carrier sub-assembly 400 and up to a location proximate to the light emitting device 602 and substrate 630. The conductive pathway in the illustrated embodiment does not terminate, pass through or include any additional intervening components between the base end 608 and substrate 630, such as another circuit board, contact, component, and the like. The contact paths 432 in the contact carrier subassembly 400 permit electric power to be supplied from the substrate 112 to the light emitting device 602.

The contact paths 432 continuously extend through the contact carrier sub-assembly 400 to a height that is at least as great as the first height dimension 610. For example, each of the contact paths 432 includes a continuous plated path that extends from the mounting post 434 to a second height dimension 612. The second height dimension 612 may represent the greatest distance between the mounting surface 418 and the outer end of the contact path 432 at the mating tab 604 in a direction along the longitudinal axis 606. For example, the second height dimension 612 may be measured in a direction along or parallel to the longitudinal axis 606. The second height dimension 612 exceeds the first height dimension 610 such that the contact paths 432 continuously extend from the base end 608 to the second height dimension 612 in order to provide a direct conductive pathway between the base end 608 and the outer ends 428 of the contact carrier sub-assembly 400. The contact paths 432 extend through the contact carrier sub-assembly 400 without terminating to or coupling with additional intervening electrical components in the device 600. Similar to the bridge contacts 120 (shown in FIG. 1), the bridge contacts 620 electrically join the contact paths 432 with the light emitting device 602.

Figure 7:
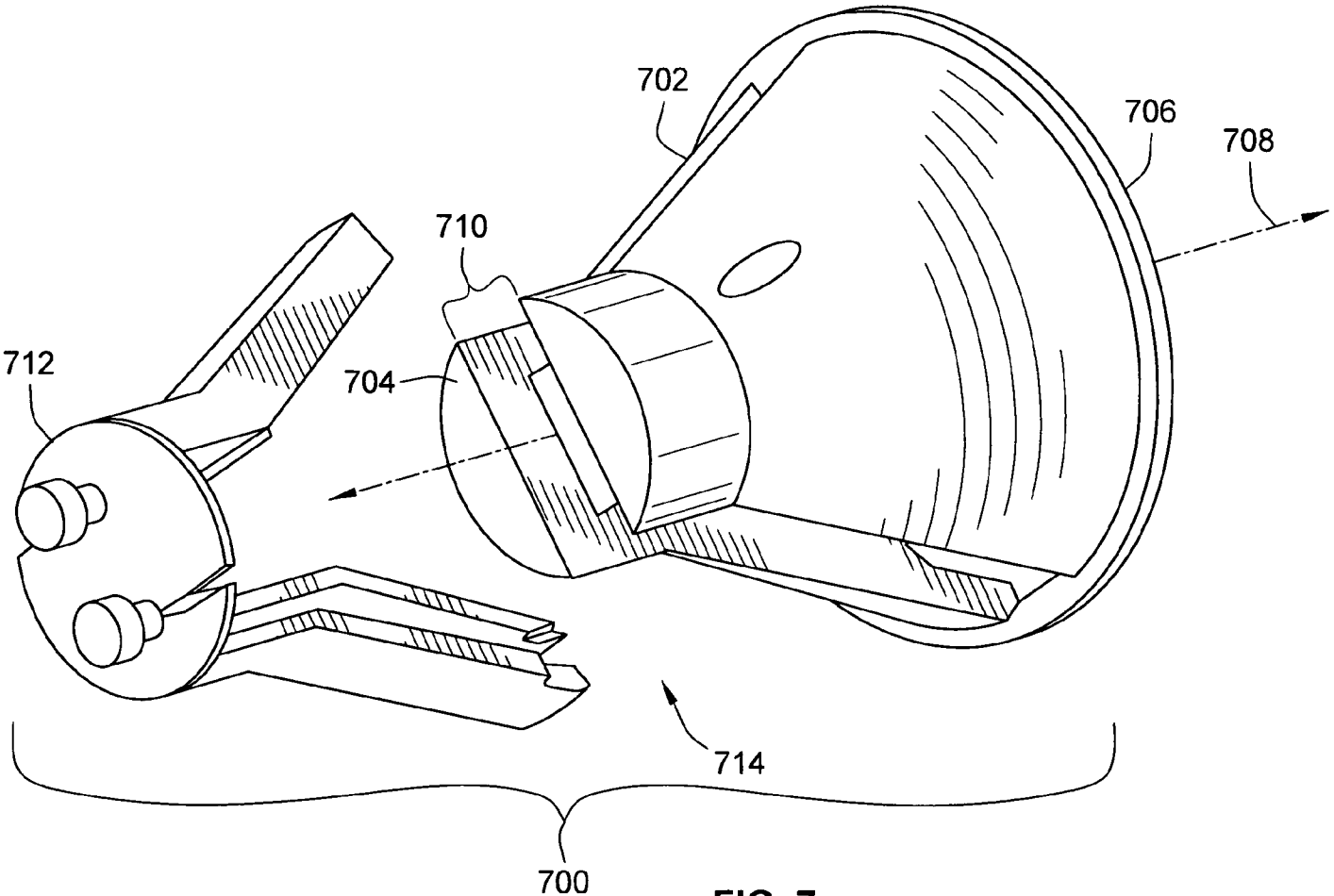
FIG. 7 is an exploded view of a lighting device in accordance with another embodiment.

FIG. 7 is an exploded view of a lighting device 700 in accordance with another embodiment. The lighting device 700 is similar to the lighting device assemblies 100 and 600 shown in FIGS. 1 and 6, respectively. For example, the device 700 includes an outer assembly 714 that is similar to the outer assemblies 128 (shown in FIG. 1) and 632 (shown in FIG. 6). In the illustrated embodiment, the outer assembly 714 extends between a base end 704 and a light emitting end 706 along a longitudinal axis 708. The outer assembly 714 is joined to a multiple contact carrier sub-assembly 712. In one embodiment, the outer assembly 714 is a heat sink. A light emitting device (not shown) that is similar to the light emitting device 102 (shown in FIG. 1) may be mounted to a substrate (not shown) that is similar to the substrate 130 (shown in FIG. 1). The outer assembly 714 includes a gap 710. The multiple contact carrier sub-assembly 712 is loaded into the gap 710.

Figure 8:
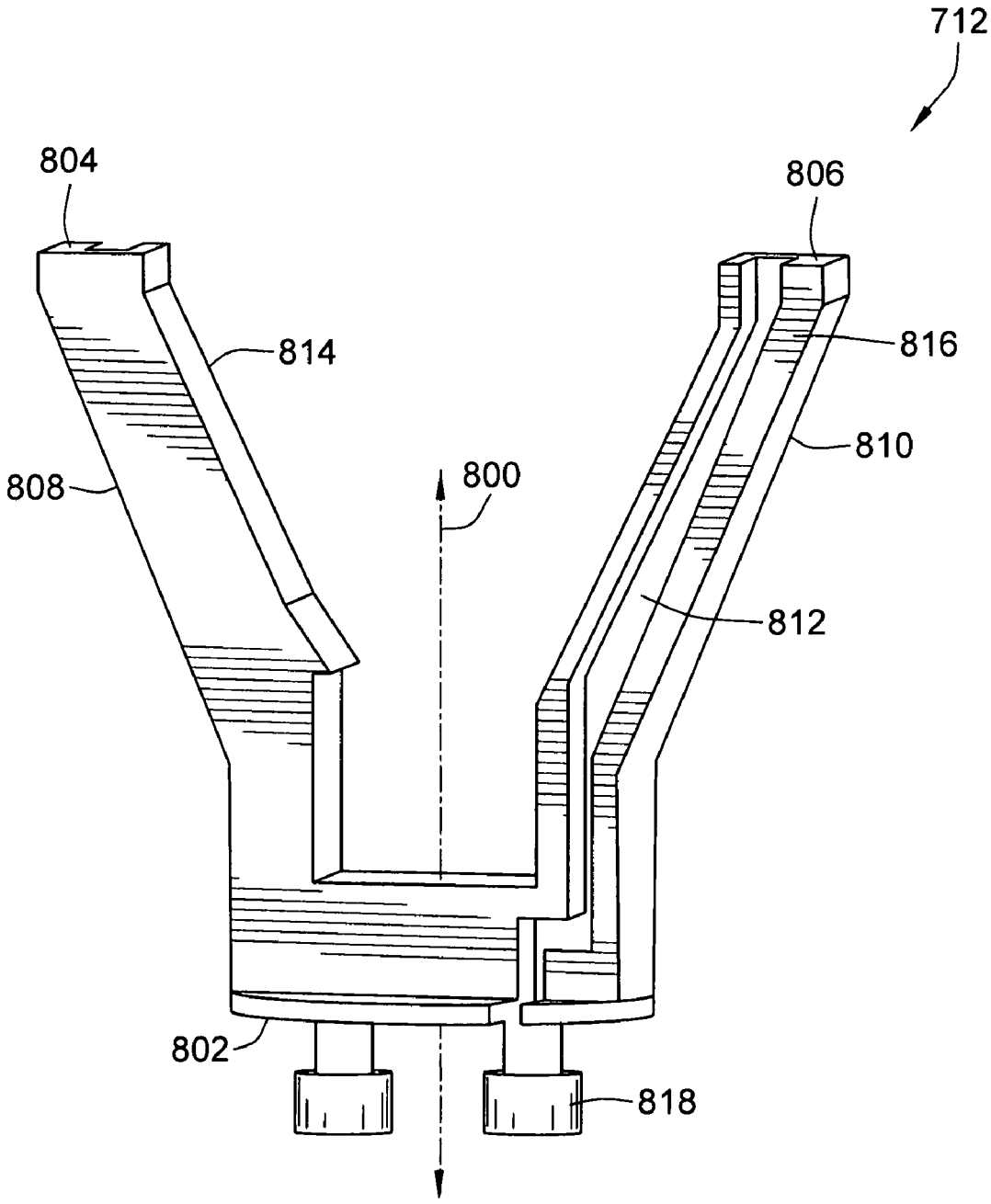
FIG. 8 is a perspective view of a contact carrier sub-assembly shown in FIG. 7 in accordance with one embodiment.

FIG. 8 is a perspective view of the multiple contact carrier sub-assembly 712 in accordance with one embodiment. The multiple contact carrier sub-assembly 712 may be similar to the contact carrier sub-assembly 400 (shown in FIG. 5). For example, the multiple contact carrier sub-assembly 712 may be a molded interconnect device that has a similar shape as the contact carrier subassembly 400. Additionally, the multiple contact carrier sub-assembly 712 is molded as a unitary body of dielectric material, similar to the contact carrier subassembly 400. In contrast to the contact carrier sub-assembly 400, the multiple contact carrier subassembly 712 is not divided into multiple sections. Instead, the multiple contact carrier sub-assembly 712 is a unitary body. The multiple contact carrier sub-assembly 712 extends along a longitudinal axis 800 between a mounting surface 802 and outer ends 804, 806 of a pair of cantilevered beams 808, 810. Each of the beams 808, 810 includes a contact path 812 that is similar to the contact path 432 (shown in FIG. 5). For example, each of the beams 808, 810 include a recessed channel extending from proximate to the mounting surface 802 to the corresponding outer end 804, 806. The channels are disposed on opposite sides 814, 816 of the multiple contact carrier sub-assembly 712. The contact paths 432 are formed by selectively plating the channels with a conductive material, such as copper. The multiple contact carrier sub-assembly 712 includes mounting posts 818 that are similar to the mounting posts 434 (shown in FIG. 5). For example, the multiple contact carrier sub-assembly 712 and mounting posts 818 may be a molded, unitary dielectric body. The contact paths 812 include the mounting posts 818. For example, the plated portions of the multiple contact carrier sub-assembly 712 include the mounting posts 818 and the contact paths 812. The plated portions of the multiple contact carrier sub-assembly 712 continuously extend across each of the mounting posts 818 and the corresponding contact path 812 through the multiple contact carrier sub-assembly 712 to the respective outer ends 804, 806.

The contact paths 812 establish a conductive pathway from the mounting posts 818 to the outer ends 804, 806 of the multiple contact carrier sub-assembly 712. As described above in connection with the contact carrier sub-assembly 400, the contact paths 812 provide a direct and continuous conductive pathway through the device 700 (shown in FIG. 7) and the multiple contact carrier sub-assembly 712 to provide electric current to the light emitting device (not shown) from the mounting device 110 (shown in FIG. 1) or the substrate 112 (shown in FIG. 1). The conductive pathways may extend through the multiple contact carrier subassembly 712 from the mounting posts 818 to the outer ends 806, 801 without terminating to or being coupled with any intervening components, such as electrical traces, circuit boards. LED drivers, wires, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first." "second." and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A lighting device comprising:

an outer assembly extending on a perimeter of the lighting device between a base end and an opposite light emitting end along a longitudinal axis, the outer assembly having a groove including a contact carrier sub-assembly disposed therein that extends on the perimeter from the base end to an outer end disposed proximate to the light emitting end a light emitting device disposed on a circuit board proximate to the light emitting end of the outer assembly, the light emitting device configured to generate and emit light from the light emitting end; and a contact held in the contact carrier sub-assembly and extending from the base end of the outer assembly to the outer end of the contact carrier sub-assembly, the contact electrically coupled with the light emitting device to provide a continuous electrically conductive path from the base end of the outer assembly to the outer end of the contact carrier sub-assembly, wherein the contact is configured to supply electric current to the light emitting device.

2. The device of claim 1, wherein the contact carrier sub-assembly is divided into substantially identical sections with the contact held between the sections.

3. The device of claim 1, wherein the contact comprises a path in the contact carrier sub-assembly that is plated with a conductive material.

4. The device of claim 1, wherein the light emitting device is mounted to a substrate in a location proximate to the light emitting end and disposed a first height dimension above the base end, further wherein the contact extends from the base end to a second height dimension above the base end that is at least as great as the first height dimension.

5. The device of claim 1, further comprising a conductive mounting post protruding from the base end and configured to mate with an external device, wherein the mounting post is electrically coupled with the contact to supply the electric current to the light emitting device.

6. The device of claim 5, wherein the mounting post comprises a plated portion of the contact carrier sub-assembly.

7. The device of claim 1, wherein the contact carrier sub-assembly is secured to the outer assembly by a snap-fit connection.

8. The device of claim 1, further comprising an optical lens disposed proximate to the light emitting end and configured to refract light generated by the light emitting device, wherein the optical lens is secured to the outer assembly by a snap-fit connection.

9. The device of claim 1, further comprising an optical lens disposed proximate to the light emitting end and configured to transmit light generated by the light emitting device. from the light emitting end; the optical lens holding a bridge contact that electrically couples the contact with the light emitting device.

10. The device of claim 1, wherein the electrically conductive path provided by the contact extends from the base end of the outer assembly to the outer end of the contact carrier sub-assembly without electrically coupling with an intervening electrical component disposed within the outer assembly between the base end and the light emitting device.

* * * * *

UNITED STATES PATENT AND TRADEMARK OFFICE

CERTIFICATE OF CORRECTION

PATENT NO. : 8,052,310 B2
APPLICATION NO. : 12/465962
DATED : November 8, 2011
INVENTOR(S) : Charles Raymond Gingrinch, III, George Daily and Matthew E. Mostoller It is certified that error appears in the above-identified patent and that said Letters Patent is hereby corrected as shown below:

On the Title Page: Item (75) (Inventors), line 1 (Inventors Name): Delete "Charles Raymond Gingrinch, III" and insert -- "Charles Raymond Gingrich, III" --, therefor.

Signed and Sealed this
Twentieth Day of December, 2011

David J. Kappos

David J. Kappos
*Director of the United States Patent and Trademark Office*